US008025194B2

(12) United States Patent
Jesewitz

(10) Patent No.: US 8,025,194 B2
(45) Date of Patent: Sep. 27, 2011

(54) CARGO RACK APPARATUS FOR BOAT TOWERS

(76) Inventor: Raymond L. Jesewitz, Longwood, FL (US)

( * ) Notice: Subject to any disclaimer, the term of this patent is extended or adjusted under 35 U.S.C. 154(b) by 898 days.

(21) Appl. No.: 11/711,282

(22) Filed: Feb. 27, 2007

(65) Prior Publication Data

US 2007/0290016 A1 Dec. 20, 2007

Related U.S. Application Data

(60) Provisional application No. 60/777,060, filed on Feb. 27, 2006.

(51) Int. Cl.
*B60R 9/00* (2006.01)
*B63B 17/00* (2006.01)

(52) U.S. Cl. ..... 224/406; 224/282; 224/548; 114/343

(58) Field of Classification Search ..... 224/406, 224/274, 405, 311, 280, 401, 282, 548, 549, 224/553; 114/343, 364
See application file for complete search history.

(56) References Cited

U.S. PATENT DOCUMENTS

| | | | | |
|---|---|---|---|---|
| 3,049,273 | A * | 8/1962 | Crane | 224/311 |
| 3,261,521 | A * | 7/1966 | Meccico et al. | 224/553 |
| 4,424,907 | A * | 1/1984 | Robb | 211/70.8 |
| 6,439,150 | B1 * | 8/2002 | Murphy et al. | 114/361 |
| 6,666,159 | B2 * | 12/2003 | Larson et al. | 114/253 |
| 6,666,163 | B2 * | 12/2003 | Pastor et al. | 114/361 |
| 6,755,332 | B2 * | 6/2004 | Crane et al. | 224/321 |
| 6,799,529 | B1 * | 10/2004 | Willis | 114/361 |
| 6,802,275 | B2 * | 10/2004 | Schmidt | 114/361 |
| 7,418,918 | B2 * | 9/2008 | Bierbower et al. | 114/361 |
| 2005/0194414 | A1 * | 9/2005 | Lynch | 224/401 |
| 2006/0037527 | A1 * | 2/2006 | Aff | 114/364 |

FOREIGN PATENT DOCUMENTS

WO WO 2006072055 A2 * 7/2006

* cited by examiner

*Primary Examiner* — Justin Larson
(74) *Attorney, Agent, or Firm* — The Patent Guild; Paul Royal

(57) ABSTRACT

A cargo rack apparatus for removable attachment to a boat, such as to the vertical supports of a wakeboard boat tower. One embodiment includes one or more peripheral rails defining front, back, and side walls, and an interior volume, and one or more crossmembers between walls to provide a support surface for stored items. The apparatus can be attached to the vertical supports of the boat tower by releasable connectors or mounts at a plurality of points, and can subsequently be easily and completely removed from the tower. Upon release of only some of the connectors, the rack pivots relative to the tower to enable the storage area of the rack to be brought closer to the user, making it easier to load and unload cargo. The entire rack can also pivot and fold down with the boat tower for storage, towing, and areas of limited clearance. An alternate embodiment provides a sliding arrangement so that the rack apparatus slides longitudinally on one or more of its rails or sides relative to the mount, and can pivot downwardly at any point during or at the end of the sliding displacement.

5 Claims, 4 Drawing Sheets

CARGO RACK APPARATUS FOR BOAT TOWERS

CROSS REFERENCE TO RELATED APPLICATIONS

The present application claims the benefit of the filing date of U.S. Provisional Patent Application Ser. No. 60/777,060, filed 27 Feb. 2006.

BACKGROUND OF THE INVENTION

1. Technical Field

The present invention relates generally to boating equipment and accessories, and more particularly to an improved cargo rack apparatus for removable attachment to wakeboard boat towers, T-top boat towers, and the like.

2. Background Art

It is a truism among boating enthusiasts that there is never enough storage room on a boat. This is particularly true in wakeboarding and related water sports, where the boater may need a place to store wakeboards, surfboards, wakesurf boards, tubes, inflatables, kayaks, accessories, and/or other sport cargo.

U.S. Pat. No. 6,192,819 to Larson, et al. discloses a water sport towing apparatus. The aerial performance characteristics of a performer using a water sport implement such as a wakeboard is enhanced by a towing apparatus which includes vertical supports rigidly attached starboard and port side gunwales of the vessel at a location generally outboard an operator station. A frame including rigid U-shaped bridging supports transversely extends across the beam of the vessel. The frame is pivotally fitted to a forward portion of the vertical supports for rotation from an operating position to a stored position on the deck of the vessel. The U-shaped bridging supports extend substantially above the level of the operator station. One of the U-shaped bridging supports is readily removably attached to the vertical support. A ball assembly is carried by detachable ends of the frame, while a socket assembly is carried by the vertical support. A shaft extends through the socket and has one end threaded for engaging a threaded bore of the ball. An opposing end of the shaft includes a knob for manipulating the shaft into and out of engagement with the ball for readily removable attachment of the ball with the socket and thus the frame with the vertical supports. As a result, the frame can be rotated downwardly onto the deck of the vessel, reducing the elevation of the vessel for passing underneath a bridge or into a garage when being carried by a trailer. A tow rope is attached to a horizontally extending bridging support portion for towing the performer.

U.S. Pat. No. 5,752,638 to Meeks describes a combination water ski and wake board rack. A rack for storing one or more pairs of water skis and wake boards includes one or more pairs of forks having parallel prongs extending from and coplanar with a base plate section. The pairs of forks are mounted on a support bar extending through an opening in the base plate section and may be positioned axially along and orientationally around the bar then clamped in the selected position such that each fork is aligned with its pair member. Each pair of forks preferably has three prongs for stowing one pair of skis or two prongs for storing a wakeboard. A strap is provided for each neighboring pair of each fork having one end attached to an end of one of said neighboring pair of prongs and another end hookable to an end of the neighboring prong so that the strap may be stretched over a water ski or wakeboard nested between neighboring prongs thereby securing a pair of skis or wakeboards.

United States Patent Application 20020053313 by Murphy, et al. teaches a shade cover assembly adapted to be carried on a tower above the cockpit area of a pleasure boat, said shade cover assembly including a generally opaque cover, a cover fixture adapted to be carried by said tower for containing the cover in a rolled up state when in the retracted position and a frame for tensioning said cover when said cover is withdrawn from said fixture and is extended in a generally horizontal position above the cockpit area.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

The present invention provides an improved cargo rack apparatus for removable attachment to a boat, such as to the vertical supports of a wakeboard boat tower or T-top boat tower. One embodiment of the inventive cargo rack includes one or more peripheral rails defining front, back, and side walls, and an interior volume, and one or more crossmembers between walls to provide a support surface for stored items. Alternatively, the cargo rack may take the form of a hardtop with a storage surface. The inventive apparatus can be attached to the vertical supports of the wakeboard boat tower by releasable connectors or mounts at a plurality of points, and can subsequently be easily and completely removed from the tower. Upon release of only some of the connectors, the rack pivots relative to the tower to enable the storage area of the rack to be brought closer to the user, making it easier to load and unload cargo. The entire rack can also pivot and fold down with the wakeboard boat tower for storage, towing, and areas of limited clearance.

An alternate embodiment of the inventive apparatus provides a sliding arrangement so that the rack apparatus slides longitudinally on one or more of its rails or sides relative to the mount, and can pivot downwardly at any point during or at the end of the sliding displacement. This embodiment enables installation on boat towers and other locations where the rack must necessarily be installed higher than is easily reachable, or where there is interference or inadequate clearance for tilting of the rack from a fixed pivot point.

The cargo rack apparatus of this invention may include, but is not limited to, the following features:

The interior volume or hardtop may include a basket portion which could be open or closed, or may include a removable shell or cargo net. One or more bungee cords or other strap members may be used to secure articles to the rack.

The crossmembers may be padded with foam or other material to offer protection from damage to stored articles.

The releasable connectors may be quick-release type cam levers.

The entire rack apparatus may be constructed of aluminum or other suitable material.

A bimini top made of canvas or other material may be releasably affixed to the rack with snaps or other fasteners.

The cargo rack may include outriggers, rod holders, speakers, lights, or other accessories.

It is therefore an object of the present invention to provide a new and improved sport cargo rack for boats.

It is another object of the present invention to provide a new and improved rack apparatus that is easily attached to existing wakeboard boat towers.

A further object or feature of the present invention is a new and improved cargo rack that folds down with the wakeboard boat tower for storage and transport.

An even further object of the present invention is to provide a novel cargo rack for boat towers that also provides a bimini top.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

BEST MODE FOR CARRYING OUT THE INVENTION

Figure 1:
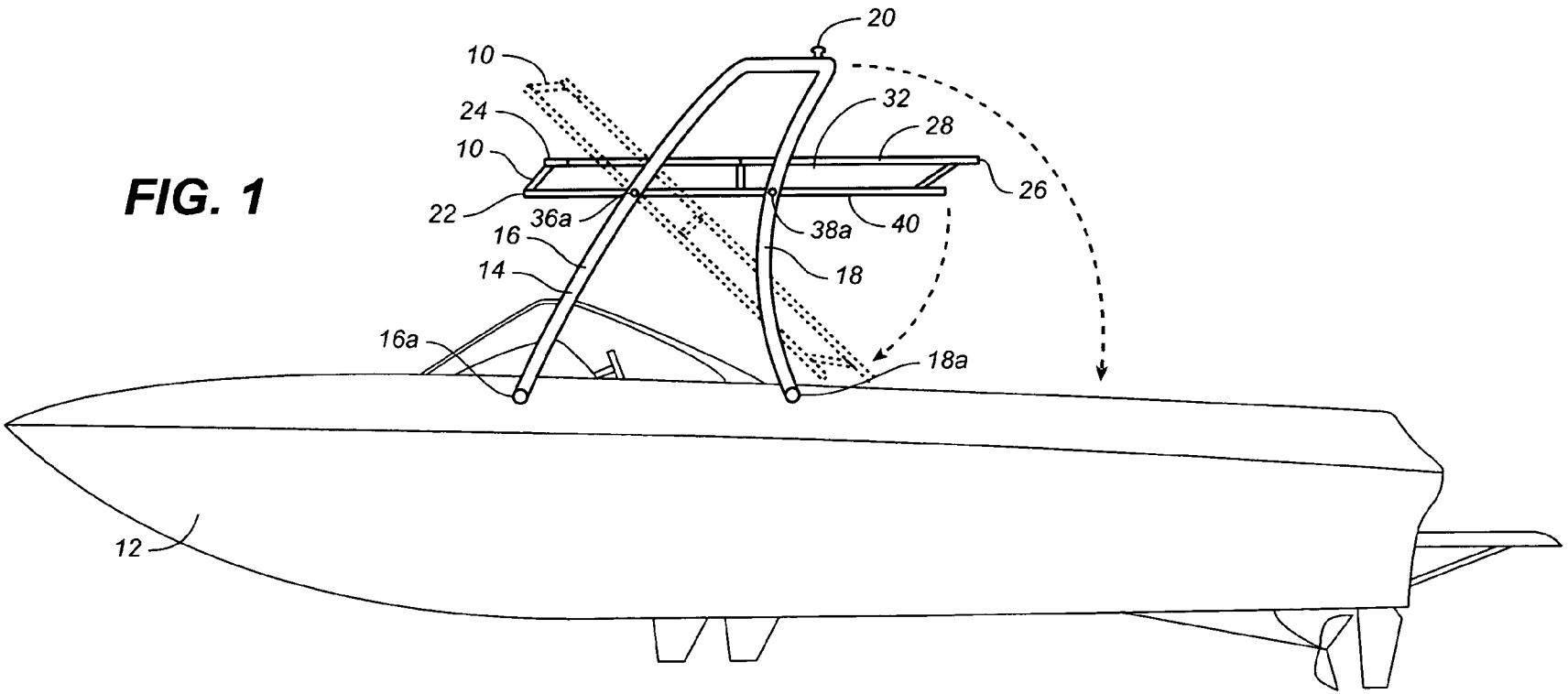
FIG. 1 is a side elevation view of a cargo rack apparatus of this invention as installed on the vertical supports of a wakeboard boat tower.

The attached drawings provide additional detail for the improved cargo rack apparatus of this invention. FIG. 1 is a side elevation view of a cargo rack apparatus 10 of this invention as installed on the vertical supports of a wakeboard boat tower. Wakeboard boat 12 includes a wakeboard tower 14 having a forward vertical support 16 and aft vertical support 18, topped with a ski tow 20. Forward vertical support 16 is preferably connected to the boat by a release joint 16*a*, while aft vertical support 18 is preferably connected to the boat by a pivot joint 18*a*. This arrangement enables the wakeboard tower to be folded down when necessary by simply disengaging forward vertical support release joint 16*a*, and pivoting the entire tower downward and aft about pivot joint 18*a*, as is well known in the art.

Cargo apparatus 10 includes one or more peripheral rails 22 defining a front wall 24, back wall 26, port side wall 28, starboard side wall 30, and an interior volume 32. One or more crossmembers 34 preferably extend between opposing walls to provide a support surface for stored items. The side walls 28, 30 attach to the vertical supports 16, 18 of the wakeboard tower at preferably four points; forward connector/pivot joints 36*a*, 36*b*, and aft connector/release joints 38*a*, 38*b*. Release of the aft joints 38*a*, 38*b* from the aft vertical supports 18 enables the cargo rack 10 to pivot about forward vertical supports 16 at forward joints 36*a*, 36*b* so that the cargo rack can tilt down for access, and pivot and fold down with the wakeboard tower for storage, towing, and areas of limited clearance. Alternatively, release of all four joints 36*a*, 36*b*, 38*a*, 38*b* from the vertical supports 16, 18 enables the cargo rack to be easily and completely removed from the wakeboard tower. Bimini top 40 may extend between the walls of the cargo rack to provide shade to the occupants of the boat.

Figure 2:
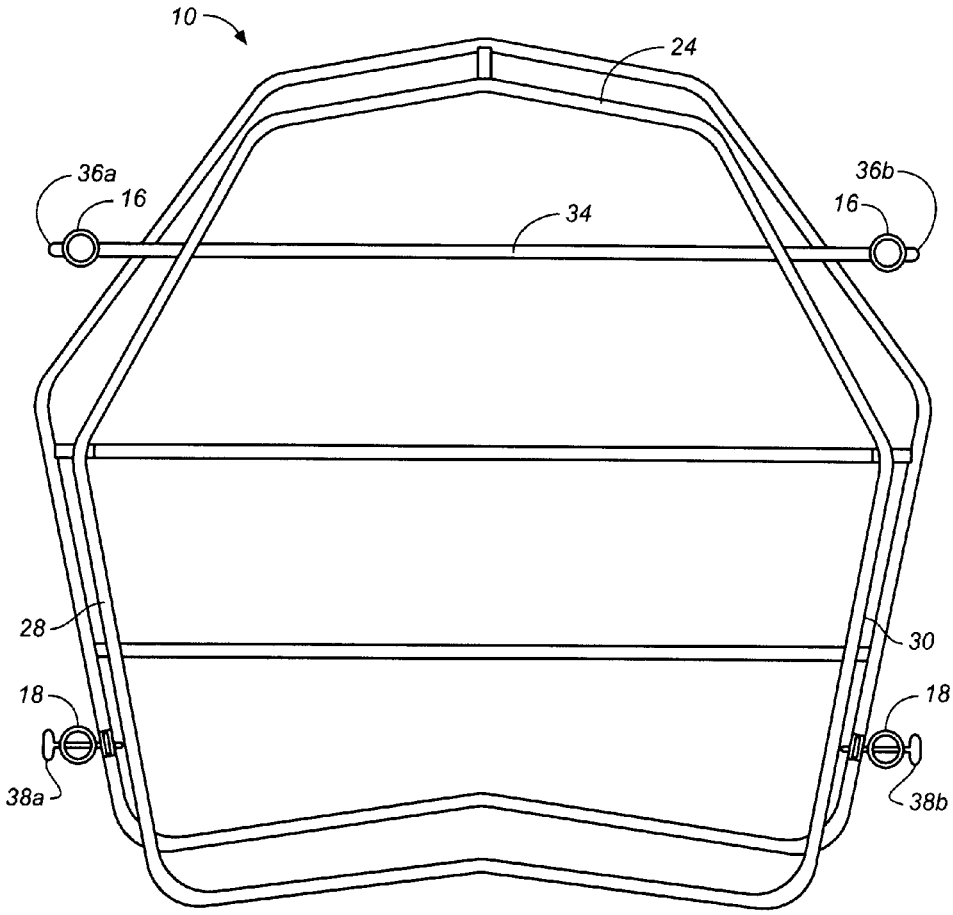
FIG. 2 is a top plan view of a cargo rack apparatus of this invention.

FIG. 2 is a top plan view of a cargo rack apparatus of this invention. This view better illustrates the crossmembers 34 extending between walls 28, 30 to provide a support surface for stored items. Forward connector/pivot joints 36*a*, 36*b*, and aft connector/release joints 38*a*, 38*b* may consist of ball and socket joints, quick-release connectors, or any other suitable hardware.

Figure 3:
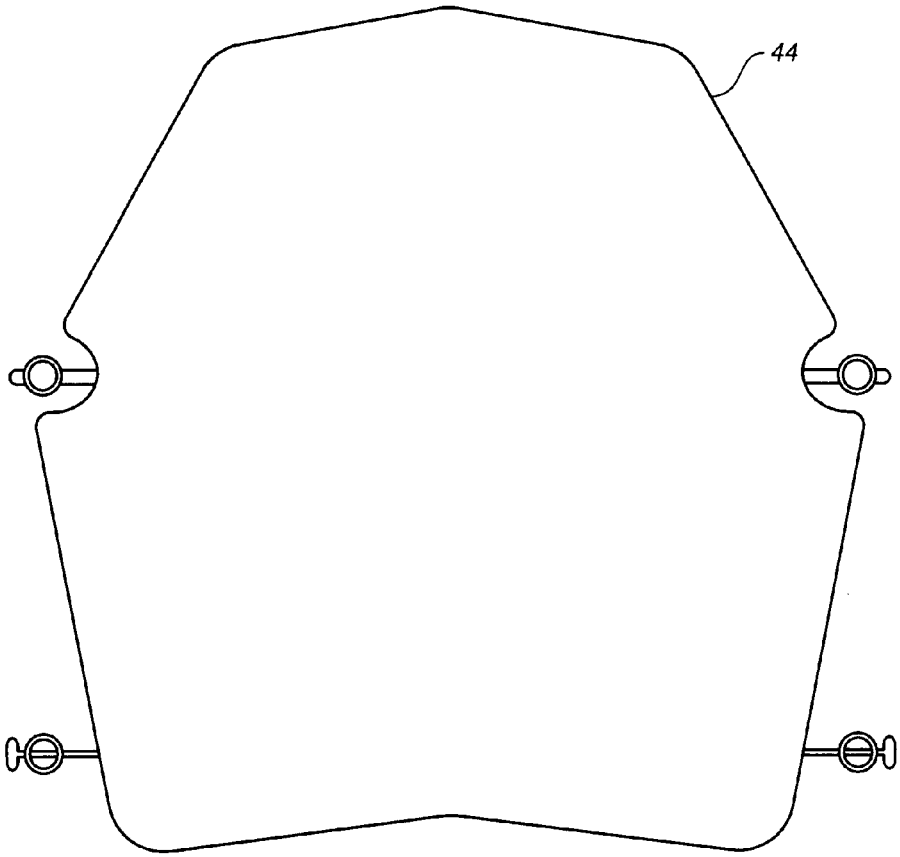
FIG. 3 is a top plan view of a hardtop embodiment of the cargo rack apparatus of this invention.

FIG. 3 is a top plan view of a hardtop embodiment 44 of the cargo rack apparatus of this invention, which can attach to a wakeboard boat tower in the same fashion as the rail embodiment.

Figure 4:
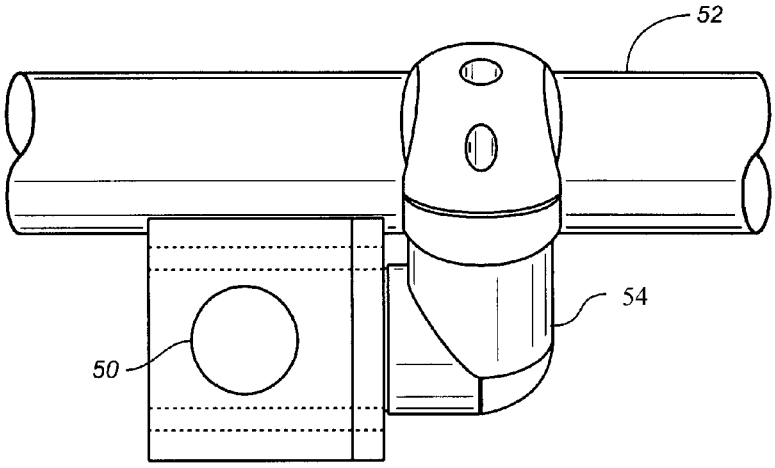
FIG. 4 is a view of an alternate sliding embodiment of the cargo rack apparatus of this invention.

FIG. 4 are views of an alternate sliding embodiment of the cargo rack apparatus of this invention. The side rails may be carried in a sleeve 50 to enable longitudinal fore-and-aft sliding of the rack relative to tower frame member 52. Pivot 54 enables tilting of the sleeve 50, and thus the rack, at any point along this sliding displacement.

This embodiment provides a sliding rail arrangement so that the rack apparatus slides longitudinally relative to its mount, and can then pivot or tilt downwardly relative to the mount at any point during or at the end of the sliding displacement, enabling easy access to the rack for loading and unloading, and the ability to fold down with the wakeboard boat tower for storage, towing, and areas of limited clearance. This embodiment enables installation on wakeboard boat towers, T-top towers, and other locations where the rack must necessarily be installed higher than is easily reachable, or where there would be interference or inadequate clearance for tilting relative to the tower. The sliding action may be achieved by mounting one or a pair of rails of the rack in a sleeve which is itself pivotally mounted to the wakeboard tower. The rack may include a releasable bracket that is engageable with a feature on the tower frame, so that when that bracket is engaged and locked, the rack is fixed in a horizontal position and suitable for use, and when that bracket is disengaged, the rack may be slid aft and pivoted downward for access or storage.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. A cargo rack apparatus removably attached to a boat tower, said boat tower including at least one forward vertical support and at least one aft vertical support, each vertical support including an upper and a lower end, said apparatus comprising: a cargo rack member providing storage and comprising at least one peripheral rail defining front, back, and side walls, and an interior volume, wherein a cross member between at least some of said walls provides a support surface for stored items; and a plurality of connectors removably and releasably suspending said cargo rack member within said vertical supports of the boat tower at a location between the upper and lower ends thereof by two forward pivot joints and two aft release joints, wherein release of said aft release joints enables said cargo rack to pivot about the forward pivot joints so that said cargo rack member can tilt down within the vertical supports of the boat tower for access to stored items.

2. The cargo rack apparatus of claim 1 further including a bimini top extending between said at least some of said walls.

3. The cargo rack apparatus of claim 1 wherein at least some of said plurality of connectors slidably engage said peripheral rail so that the cargo rack member slides longitudinally relative to said connectors, and can then tilt downwardly at any point of the sliding displacement for access to the cargo rack member for loading and unloading, and for folding down with the boat tower for storage.

4. The cargo rack apparatus of claim 1 wherein said peripheral rail is mounted in a sleeve which is itself pivotally mounted to the boat tower.

5. The cargo rack of claim 1 wherein said cargo rack member comprises a hardtop.

* * * * *

UNITED STATES PATENT AND TRADEMARK OFFICE

CERTIFICATE OF CORRECTION

PATENT NO. : 8,025,194 B2
APPLICATION NO. : 11/711282
DATED : September 27, 2011
INVENTOR(S) : Raymond L. Jesewitz It is certified that error appears in the above-identified patent and that said Letters Patent is hereby corrected as shown below:

In the Specification

COL. 1, LINE 4 AFTER TITLE PLEASE INSERT:

-- CROSS REFERENCE TO RELATED APPLICATIONS

This application is a Continuation-in-part of International Application No. PCT/US2005/047583, filed 28 December 2005 [now withdrawn], which claims the benefit of Provisional Application No. 60/640,004, filed 28 December 2004 [now expired] and this application also claims the benefit of Provisional Application No. 60/777,060, filed 27 February 2006 [now expired]. --

Signed and Sealed this
Twenty-eighth Day of April, 2015

Michelle K. Lee

Michelle K. Lee
*Director of the United States Patent and Trademark Office*